US007453366B2

(12) United States Patent
Grilliot et al.

(10) Patent No.: US 7,453,366 B2
(45) Date of Patent: Nov. 18, 2008

(54) PROGRAMMABLE EARPIECE

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 181 days.

(21) Appl. No.: 11/247,486

(22) Filed: Oct. 11, 2005

(65) Prior Publication Data

US 2007/0080817 A1 Apr. 12, 2007

(51) Int. Cl.
*G08B 17/00* (2006.01)

(52) U.S. Cl. ..... 340/584

(58) Field of Classification Search ..... 340/584, 340/870.17, 586, 573.1, 691.1, 632; 381/312, 381/381

See application file for complete search history.

(56) References Cited

U.S. PATENT DOCUMENTS

| | | | | |
|---|---|---|---|---|
| 5,815,126 | A * | 9/1998 | Fan et al. | 345/8 |
| 5,990,793 | A * | 11/1999 | Bieback | 340/573.1 |
| 6,118,382 | A * | 9/2000 | Hibbs et al. | 340/586 |
| 6,995,665 | B2 * | 2/2006 | Appelt et al. | 340/521 |
| 7,203,331 | B2 * | 4/2007 | Boesen | 381/380 |
| 2002/0135488 | A1 * | 9/2002 | Hibbs et al. | 340/584 |
| 2002/0190923 | A1 * | 12/2002 | Ronzani et al. | 345/50 |
| 2005/0177034 | A1 * | 8/2005 | Beaumont | 600/323 |
| 2006/0125623 | A1 * | 6/2006 | Appelt et al. | 340/521 |

* cited by examiner

*Primary Examiner*—Phung Nguyen
(74) *Attorney, Agent, or Firm*—Wood, Phillips, Katz, Clark & Mortimer

(57) ABSTRACT

For a firefighter or for an emergency rescue worker, an earpiece comprising a speaker, a microphone, and a temperature sensor comprises a programmable chip, which is programmed to sound an alarm via the speaker if and only if a temperature sensed by the temperature sensor equals or exceeds a preset temperature. The speaker and the microphone provide for audible communication between a wearer and another.

6 Claims, 1 Drawing Sheet

PROGRAMMABLE EARPIECE

TECHNICAL FIELD OF THE INVENTION

This invention pertains to an earpiece, which can be advantageously worn by a firefighter or by an emergency rescue worker. This invention contemplates that the earpiece is programmable and is programmed to sound an alarm, via a speaker of the earpiece, if a sensed temperature equals or exceeds a preset temperature.

BACKGROUND OF THE INVENTION

Measuring body core temperature or measuring a temperature enabling body core temperature to be calculated, determined, or approximated can be very important to a firefighter or to an emergency rescue worker, either of whom can become overheated to a potentially fatal condition.

In United States Patent Application Publication No. US 2004/0242976 A1, the disclosure of which is incorporated herein by reference, it is disclosed in FIG. 55 and in paragraph 0439 to mount a temperature sensor on a nosepiece of a mask, such as a mask for a firefighter. The temperature sensor is used to sense, on an external region on the nose of a wearer, a temperature approximating body core temperature.

In United States Patent Application Publication No. US 2005/0177034 A1, the disclosure of which is incorporated herein by reference, an ear canal sensing device is disclosed. The ear canal sensing device, which is inserted into an ear canal of a wearer, is employed to monitor physiological factors, which can include a temperature approximating body core temperature. Furthermore, it is disclosed that the ear canal sensing device can be also adapted to provide full duplex (two-way) communication, via a speaker and a microphone.

As exemplified in numerous prior patents including U.S. Pat. Nos. 4,993,419, 5,012,813, 5,199,436, 5,445,158, 5,381,796, 5,653,238, 6,047,205, and 6,219,573 B1, technology is known, by which to calculate, determine, or approximate body core temperature from a temperature sensed in an ear canal.

SUMMARY OF THE INVENTION

Broadly, this invention provides a earpiece comprising a speaker, being programmable, and being programmed to sound an alarm via the speaker if a temperature sensed by a temperature sensor equals or exceeds a preset temperature. Preferably, the earpiece is programmed to sound an alarm via the speaker if and only if the sensed temperature equals or exceeds the preset temperature. Preferably, the earpiece comprises a temperature sensor and is programmed to sound an alarm via the speaker if a temperature sensed by the temperature sensor equals or exceeds the preset temperature.

Preferably, the earpiece is programmed (a) to store a preset temperature, (b) to receive a temperature sensed by the temperature sensor, (c) to compare the sensed and preset temperatures, and (d) if the sensed temperature equals or exceeds the preset temperature, then to sound an alarm via the speaker, but (e) if the sensed temperature does not equal or exceed the preset temperature, then not to sound the alarm.

DETAILED DESCRIPTION OF THE ILLUSTRATED EMBODIMENT

Figure 1:
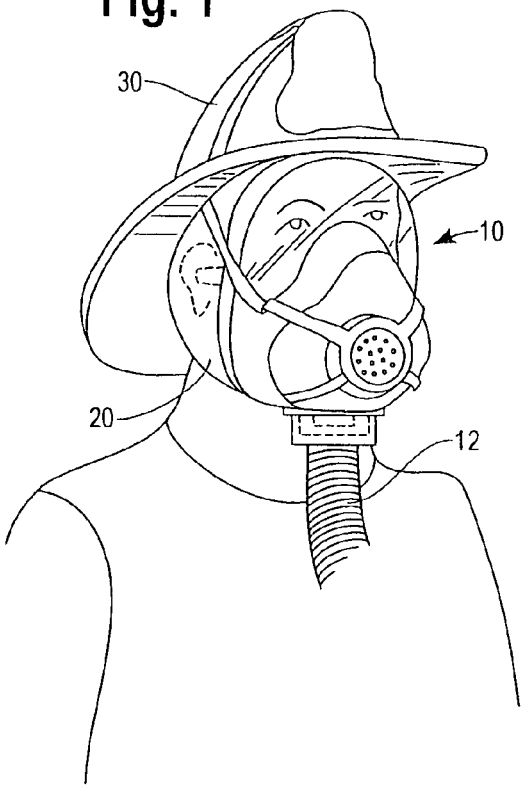
FIG. 1 is a fragmentary, pictorial view illustrating a firefighter, who is wearing a face mask connected by a hose to an air tank (not illustrated) of a self-contained breathing apparatus and who also is wearing a hood, a helmet, and an earpiece, which is mounted to a frame of the facemask, via an arm.
Figure 3:
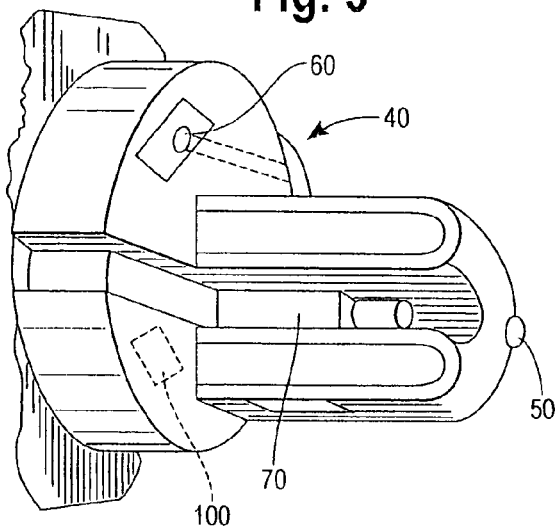
FIG. 3, on a larger scale compared to FIG. 2, is a perspective view of the earpiece.
Figure 2:
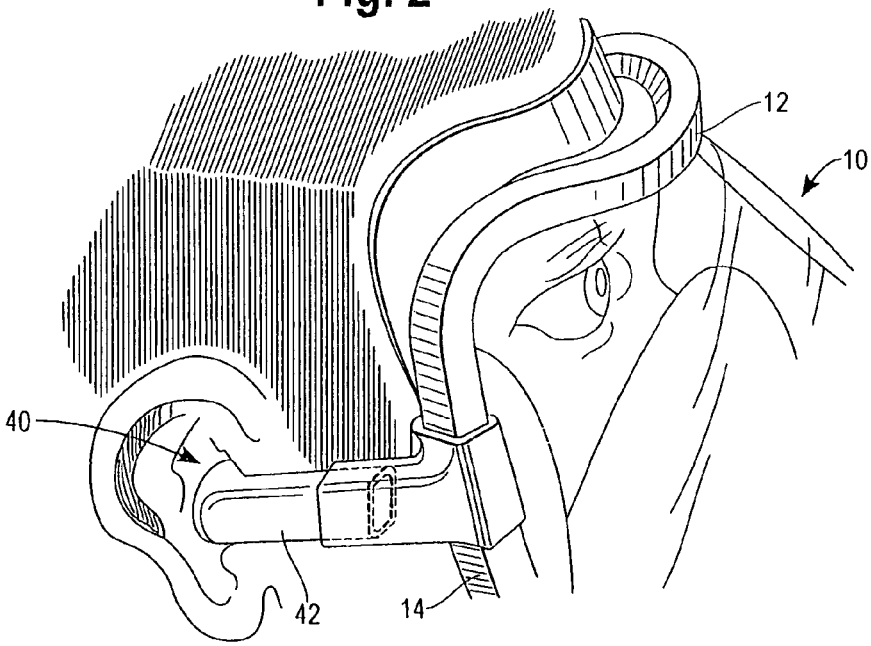
FIG. 2, on a larger scale compare to FIG. 1, is a fragmentary, pictorial view of what is illustrated in FIG. 1, as seen from a different vantage without the hood and without the helmet.

As illustrated in FIGS. 1 and 2, a firefighter is wearing a face mask 10, which is connected by a hose 12 to an air tank of a self-contained breathing apparatus and also is wearing a hood 20, a helmet 30, and an earpiece 40, which is mounted to a frame 12 of the facemask 10, via an arm 42 mounted to a side portion 14 of the frame 12. The arm 42 is a telescoping arm, which can be lengthwise adjusted and which can be upwardly and downwardly adjusted along the side portion 14 of the frame 12, so as to enable the earpiece 40 to be properly positioned where a projecting portion 42 of the earpiece 40 can enter the ear canal of one ear of the firefighter. Except as illustrated and described herein, the earpiece 40 is similar to the ear canal sensing device disclosed in United States Patent Application Publication No. US 2005/0177034 A1, supra.

On the projecting portion 42, the earpiece 40 has a temperature sensor 50, which is useful to sense a temperature continuously, intermittently, or whenever polled, at a location at or near a surface of the firefighter's ear canal entered by the projecting portion 42. Via known technology, the sensed temperature is used to calculate, determine, or approximates the body core temperature of the firefighter wearing the earpiece 40. The sensed temperature can be electronically transmitted, either via a wired connection (not illustrated) or wirelessly, e.g., via Bluetooth technology, to a monitor carried by the firefighter in a pocket. Desirably, the monitor is equipped with an alarm, which emits an audible signal whenever the sensed temperature equals or exceeds a preset temperature. The sensed temperature can be wirelessly transmitted, e.g., via simplex (one-way) radio communication, to a monitor being monitored by a safety officer, who may be located at a command center.

On the projecting portion 42, the earpiece 40 has a microphone 60, which enables the firefighter wearing the earpiece to speak to another firefighter, a safety officer, or an incident commander, who may be located at a command center. On the projecting portion 42, the earpiece 40 has a speaker 70, which enables another firefighter, a safety officer, or an incident commander, who may be located at a command center, to speak to the firefighter wearing the earpiece 40. The microphone 60 and the speaker 70 may be components of a duplex (two-way) radio communications system.

In a preferred embodiment, the earpiece 40 has a programmable microchip 100, which is programmed (a) to store a preset temperature, (b) to receive a temperature sensed by the temperature sensor 50, (c) to compare the sensed and preset temperatures, and (d) if the sensed temperature equals or exceeds the preset temperature, then to sound an alarm via the speaker 70, but (e) if the sensed temperature does not equal or exceed the preset temperature, then not to sound the alarm.

In an alternative embodiment, the temperature sensor 50 is not employed in step (b) but the microchip 100 is programmed in step (b) to receive a temperature sensed by one of the temperature-sensing means disclosed in United States Patent Application Publication No. US 2005/0177034 A1, supra.

The invention claimed is:

1. An earpiece comprising a speaker and a temperature sensor, the earpiece being programmable, and being programmed (a) to store a preset temperature, (b) to receive a temperature sensed by the temperature sensor, (c) to compare the sensed and preset temperatures, and (d) if the sensed temperature equals or exceeds the preset temperature, then to sound an alarm via the speaker, but (e) if the sensed temperature does not equal or exceed the preset temperature, then not to sound the alarm.

2. The earpiece of claim 1 wherein the temperature sensor is located to sense a temperature of a wearer's ear canal.

3. An earpiece comprising a speaker, being programmable, and being programmed (a) to store a preset temperature, (b) to receive a sensed temperature, (c) to compare the sensed and preset temperatures, and (d) if the sensed temperature equals or exceeds the preset temperature, then to sound an alarm via the speaker, but (e) if the sensed temperature does not equal or exceed the preset temperature, then not to sound the alarm.

4. The earpiece of claim 1 or 3, wherein the speaker provides for audible communication to a wearer from another.

5. The earpiece of claim 1 or 3, wherein the earpiece further comprises a microphone, and wherein the speaker and the microphone provide for audible communication between a wearer and another.

6. An earpiece comprising a speaker, and a temperature sensor, the earpiece being programmable, and being programmed to sound an alarm via the speaker if a temperature sensed by the temperature sensor equals or exceeds a preset temperature;

wherein the temperature sensor is located to sense a temperature of a wearer's ear canal.

* * * * *